United States Patent [19]

Hamburger et al.

[11] 4,349,230

[45] Sep. 14, 1982

[54] TUNNEL BORING MACHINE

[75] Inventors: Herman Hamburger, Geneva; Robert G. Dillingham, Bolingbrook, both of Ill.

[73] Assignee: Zokor Corporation, Aurora, Ill.

[21] Appl. No.: 64,162

[22] Filed: Aug. 10, 1979

[51] Int. Cl.[3] ..... E21D 9/08

[52] U.S. Cl. ..... 299/33; 299/67; 299/75

[58] Field of Search ..... 299/33, 11, 67, 75; 405/141

[56] References Cited

U.S. PATENT DOCUMENTS 3,404,920 10/1968 Tabor ..... 299/33 X
3,556,599 1/1971 Fikse ..... 299/33
3,612,609 10/1971 Reuls ..... 299/33
4,077,670 3/1978 Spies et al. ..... 405/141 X

FOREIGN PATENT DOCUMENTS 2437669 2/1976 Fed. Rep. of Germany ..... 299/11

*Primary Examiner*—Ernest R. Purser
*Attorney, Agent, or Firm*—Brezina & Buckingham

[57] ABSTRACT

In a tunneling machine including a hollow shield, a non-rotatable outer housing mounted in the shield for longitudinal movement, and inner housing rotatably mounted within the outer housing, an excavator including a boom and bucket pivotally mounted on the forward end of the inner housing, and a boom cylinder having a forward portion pivotally engaged with the boom and a rear portion mounted at the rearward portion of the inner housing.

8 Claims, 4 Drawing Figures

TUNNEL BORING MACHINE

This invention relates to improvements in articulated boom bucket or boom dipper bucket excavators for a tunnel boring machine of a type which has an outer cylindrical shield having a front circular cutting edge, the excavator assembly being mounted in the shield for rotatable movement about a central axis.

BACKGROUND OF THE INVENTION

This invention is an improvement of the excavator assembly which is the subject matter of co-pending application Ser. No. 013,523 filed Feb. 21, 1979, now U.S. Pat. No. 4,203,626 and over other prior art excavator assemblies mounted on the front of a mounting ring which constitutes the forward portion of the central rotably mounting means. Such assemblies may include a large bearing, pinion gears affixed to the outer race of the bearing, driven by motors affixed to a bulkhead in the center of the shield, a generally conical housing extending rearwardly from the bulkhead and which has manifold means at the rear end for rotationally connecting the hydraulic lines from the power source with the hydraulic lines which operate the excavator through the mounting means.

SUMMARY OF THE INVENTION

In an assembly in accordance with this invention, the rearward pivot point of a boom cylinder is positioned at a rearward point inside the mounting means and behind the forward pivot point of the boom cylinder which is mounted on the upper portion of an "L" shaped boom element. By doing so the cutting force near the periphery of the excavated area, is increased relative to the normally greater force at the center due to the positioning of the excavator. As a result, a smaller boom cylinder can be used to achieve a given minimum cutting force throughout the excavating surface. This in turn permits a lighter excavator construction having better weight distribution with fewer cylinders and pivot points. This results in greater speed and mobility of the excavator per given hydraulic force and capacity which may be available and enables construction of smaller diameter tunneling machine to meet given power requirements than could be constructed using prior art structures.

The mounting assembly for the excavator is an outer cone shaped housing which is movable longitudinally inside the tunnelling machine on a track or channel which is rigidly mounted within the main shield of the tunnelling machine. This outer housing supports, at its rearward end a fixed portion of a rotary manifold through which hydraulic fluids used to move the excavator components are passed. The front end of the cone shaped housing is rigidly connected to the inner race of a large bearing which supports a rotatable inner housing on which the excavator is rotably mounted to permit 360 degree movement about the longitudinal axis of the tunnelling machine.

The inner portion of the excavator is a generally right-angled triangularly shaped boom, pivotably mounted on a mounting ring which comprises the forward portion of the rotatable housing. In contrast to the prior art excavator mountings which have the inner end of the boom activating cylinder mounted on the mounting ring, i.e. forward of the bearing, applicant mounts the boom cylinder at the back end of the rotatable cone shaped portion of the housing with the forward end of said cylinder pivotably mounted to the boom at a point generally inside the bearing. This novel mounting structure results in a significantly larger breakout force existing at the outer periphery of the cutting area of the bucket. This improvement is significant if not critical in these types of machines where ground conditions requiring breakout forces of 100 to 300 tons and the rating of the machine is based on the weakest breakout force it can exert, that is, at the periphery of the cutting surface.

Since there is more uniform breakout force throughout the cutting surface, any given ground condition utilizing this invention can utilize smaller cylinders since the differential between the breakout force in the center and periphery is substantially reduced. Under any given available hydraulic pressures and flows, the use of smaller cylinders, which have less hydraulic capacity, results in a more rapid movement of the digging components and faster digging rates.

By having more of the weight of the excavator assembly rearward of the bearing, better weight distribution is achieved permitting the use of a smaller bearing compared with the prior art structures which have all of the weight located forward of the bearing.

The use of the excavator construction of this invention permits the use of single cylinders to perform each movement function, allows economy to be achieved in the original construction and in maintenance. Further, by having single cylinders located in the center of the excavator segments, the supporting pivot points are located on either side thereof giving greater transfer support and providing for a more rigid boom construction when compared with a double piston structure gaving the support between the two cylinders.

It has been further found that the excavator structure of this invention permits construction of tunnelling machines of a size hitherto unattainable. Given ground conditions requiring moderate to high breakout forces on the order of 50 to 100 tons, it was not possible to construct tunnelling machines which would deal with these ground conditions on a smaller size of under approximately 15 feet in diametr. In the design of smaller machines, as the diameter was reduced the amount of space was reduced necessitating some scaling down of the size of the components of the excavator. As these sizes were scaled down, the lever arm of the components became smaller necessitating hydraulic cylinders of larger diameter but of a shorter over-all length. As a result due to space limitations, it was not possible to design a tunnelling machine of this type of a diameter smaller than about 15 or 16 feet. With the design of this invention it is possible to design tunnelling machines substantially smaller in diameter to on the order of 12 feet in diameter, thus providing applications such as in mining and water tunnel construction never before available in ground conditions where the use of this type of machine is the most practical.

This invention has other objects, features and advantages which will become more fully apparent from the following detailed descriptions taken in conjunction with the accompanying drawings.

DESCRIPTION OF THE PREFERRED EMBODIMENTS

Figure 1:
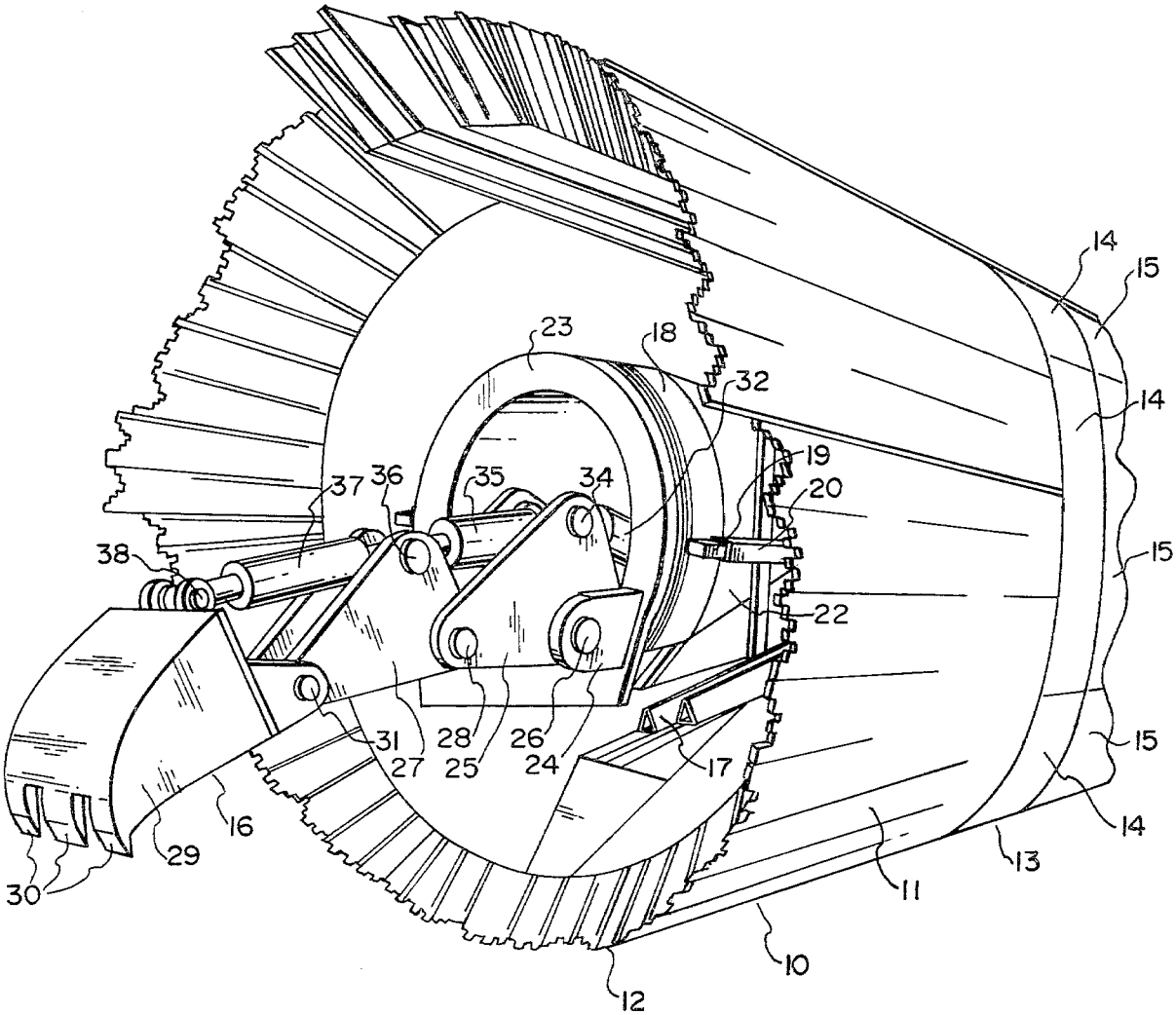
FIG. 1 is a perspective view of a forward end portion of a tunnelling machine constructed in accordance with the invention.

Referring now to the drawings in greater detail, there is illustrated in FIG. 1 a tunnel boring machine 10 for tunnelling through material of intermediate hardness. As shown, the machine 10 includes a hollow cylindrical shield 11 having a front circular cutting edge 12 and a rear edge 13. Several jack assemblies (not shown) are positioned between the rear edge of the shield and the front edge of a concrete tunnel line 14 which is formed in increments from quarter-cylindrical precast concrete segments 15.

As the tunnel boring machine 10 digs out the material at the front end of the machine, the jacks are operated to push the cutting edge 12 against the periphery of the hole being dug to finish the "cut" of the cylindrical hole. Then, after the jacks have been fully extended, they are contracted and then the jack assemblies are retracted so that the concrete segments 15 can be positioned in a ring to form another increment of the tunnel liner 14. Then the jack assemblies are repositioned between the rear edge 13 and the front edge of the tunnel liner 14 for pushing the tunnel boring machine 10 against the material through which the machine is tunnelling.

As the tunnel is built, generally in the manner briefly described above, a track is laid in the tunnel for carrying flat cars that carry concrete segments 15 to the machine 10 and for carrying gondola cars that are used to haul away material as it is excavated from the front of the tunnel.

As shown in FIG. 1, the machine 10 also includes an excavator 16 which is mounted at the front end of the machine 10 and a conveyor 17 for conveying excavated material from the bottom front of the machine 10 upwardly over the forwardmost gondola car.

As shown in FIG. 1, the mounting for the excavator 16 includes a bulkhead 18 which has a rail 19 mounted on each side thereof. Each of the rails 19 is received within a channel member 20 fixed within and to the shield 12. A piston and cylinder assembly (not shown) is provided for reciprocating the bulkhead 18 along the longitudinal axis of the shield with the rails 19 sliding in the channels 20. Mounted to the bulkhead 18 is a fixed outer housing 22 which extends axially toward the rear of the machine.

The excavator 16 is rotatably mounted to the fixed bulkhead 18 by means of mounting ring 23 and additional mechanism described below. The mounting ring 23 has an ear 24 for pivotally mounting a boom 25 on a boom pivot pin 26. A dipper member 27 is pivotally mounted on the boom 25 by means of a dipper pivot pin 28. A scoop or bucket 29 having cutting teeth 30 is pivotally mounted on the dipper member 27 by means of a bucket pivot pin 31.

The boom 25 is rotated about a pivot axis transverse to the longitudinal axis of the shield 11 on pin 26 by a boom piston and cylinder assembly 32. The rearward portion of the piston and cylinder assembly 32 is pivotally mounted in a manner described below, to the rear portion (not shown) of a rotatable housing 22 affixed to mounting ring 23 and its front portion is pivotally mounted to the upper part of the boom 25 through a pin 34 which also mounts the rear portion of a dipper cylinder assembly 35.

The dipper member 27 is pivoted by the dipper cylinder assembly 35 about a pivot axis transverse to the longitudinal axis of the shield 12 which extends through pin 28.

The bucket 29 is driven about an axis transverse to the axis of the shield 12 through pin 31 by a bucket cylinder assembly 37.

A mechanism (not shown in FIG. 1 but which may be like that shown in FIG. 2) is provided for rotating the mounting ring 23 360 degrees in a plane normal to the central axis of the shield 12.

It will be apparent from the description of the excavator 16 and the bucket-dipper-boom assembly thereof shown in FIG. 1 that five degrees of motion are provided with the excavator 16.

The first degree of motion is the reciprocal motion provided by the power mechanism for reciprocating the bulkhead in the channels 20. This movement provides an in and out movement of the excavator 16 along the central axis of the shield 11.

A second degree of movement is provided by the rotational mounting of the base 23 on the bulkhead 18.

A third degree of movement is provided by the boom piston and cylinder assembly 32 which provides for movement of the outer end of the boom 25 toward and away from the central axis.

A fourth degree of movement is provided by the dipper piston and cylinder assembly 35 which provides pivoting movement of the dipper member 27 about the axis of pin 28 on the forward end of the boom 25.

Finally, a fifth degree of movement is provided by the bucket piston and cylinder assembly 37 which provides pivotal movement of the bucket or scoop 29 about the axis of pin 31 on the forward end of the dipper member 27.

Figure 2:
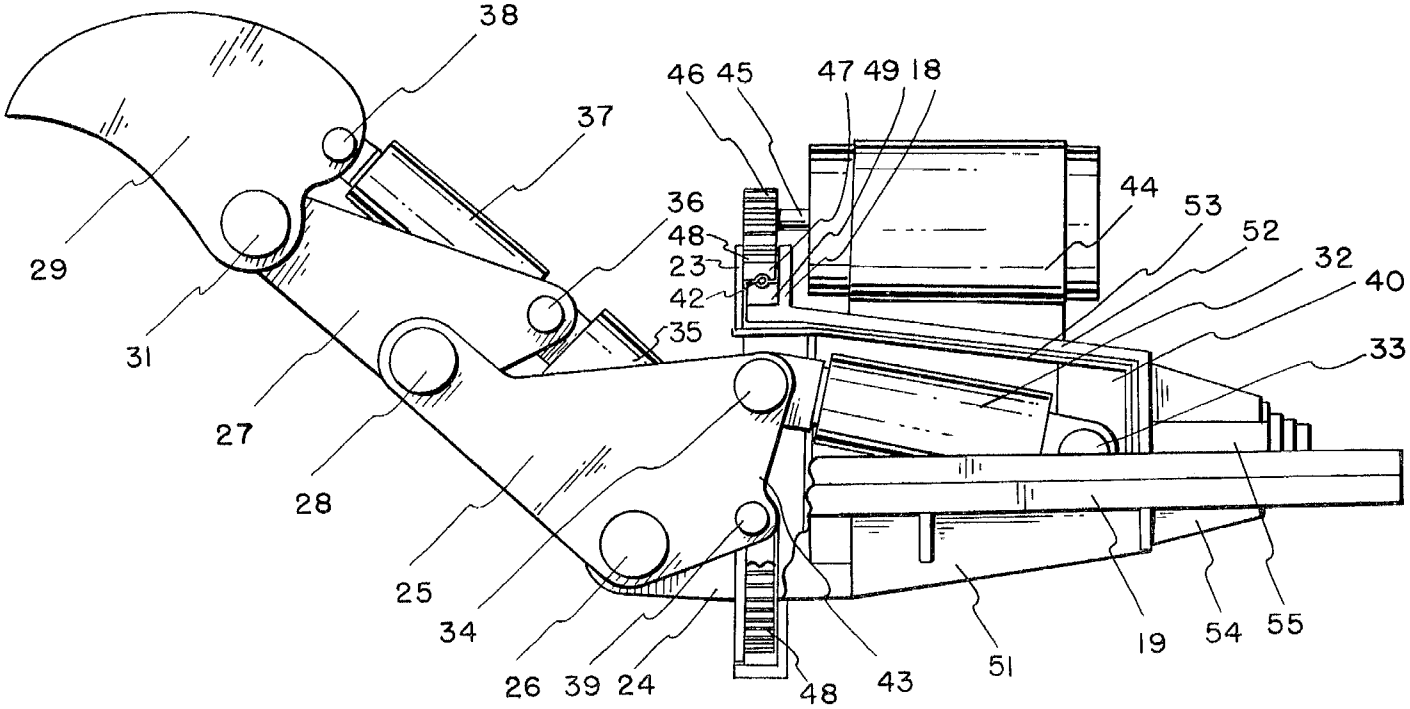
FIG. 2 is a side elevational view of a modified excavator mounting assembly.

FIG. 2 is a side elevational view of a modified embodiment of the excavator and excavator mounting assembly tunnel boring machine shown in FIG. 1. In this embodiment the construction and arrangement of the various parts of the excavator 16 are slightly different from the construction and arrangement of the parts of the excavator 16 shown in FIG. 1. As shown, the excavator 16 includes a bulkhead 18 having a rail 19 mounted on each side thereof. Each of the rails 19 is received within and slidably moveable within one of the two channel members (not shown) positioned on either side of the shield. It differs from the structure of FIG. 1 in that the rear of dipper piston and cylinder assembly 35 is mounted on a separate pivot pin 39 at the rearward portion of boom 25 rather than at the boom piston and cylinder assembly driving pin 34, an option which can be useful where lower hydraulic pressures are used.

To rotate the mounting ring 23, a motor 44 drives a pinion gear 45 which drives a ring gear 46 rigidly attached to or forming an integral part of the mounting ring 23. Ring gear 46 is on the outside of and affixed to an outer race 47 of a bearing 48. An inner race 49 of bearing 48 is affixed to the bulkhead 18. The fixed outer housing 22 comprises a rear housing assembly 51 including a cone-shaped housing 52 which supports the inner bearing race 49 at its forward end and which surrounds an inner housing member 53 which is secured to and rotates with the mounting ring 23.

Hydraulic fluid is supplied to the various cylinders through a rotary manifold including outer stationary part 54 and an inner rotatable part 55 affixed to and rotates with the inner housing member 53. Mounting ear 40 is affixed to the back wall of rotatably housing 53. Boom cylinder and piston assembly 32 is pivotably mounted on ear 40 by pivot pin 33.

Figure 3:
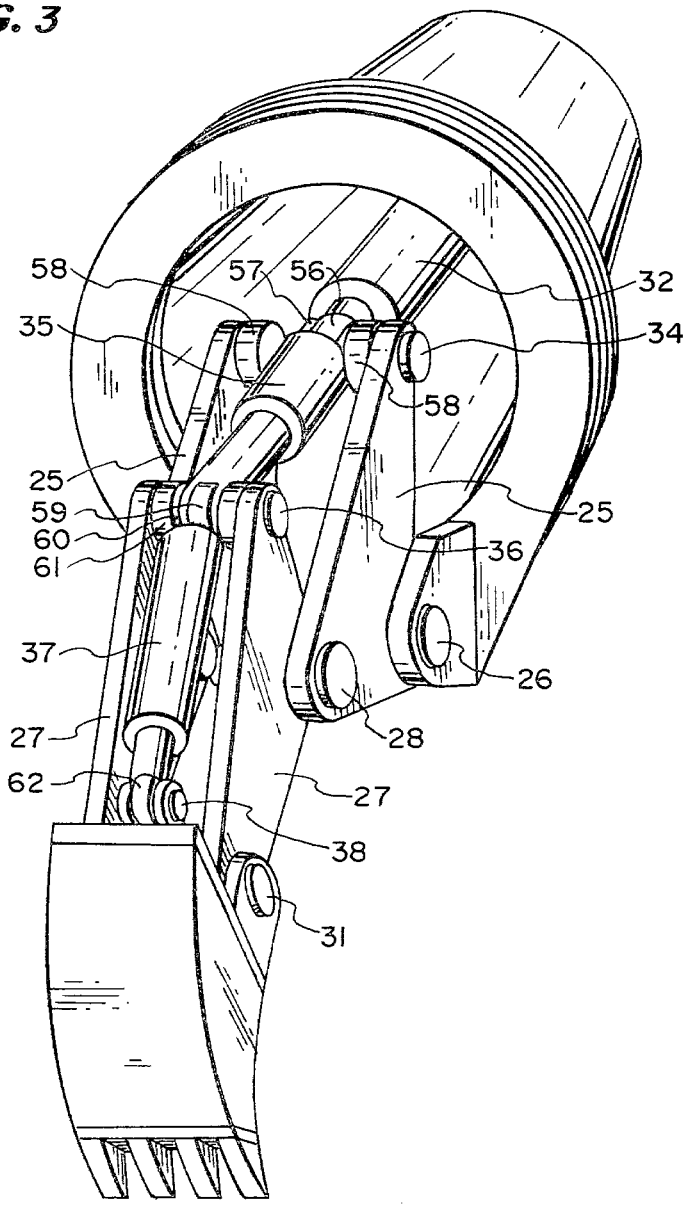
FIG. 3 is a perspective view showing details of the excavator mounting structure of the machine of FIG. 1; and, FIG. 4 is a graph showing the breakout forces obtained with the various constructions.

FIG. 3 shows boom piston and cylinder assembly 32 with a clevis 56 pivotally connected to pin 34. The rear end of dipper piston and cylinder assembly 35 has a clevis 57 also mounted on pin 34. Spacers 58 hold clevises 56 and 57 centered between boom segments.

The forward end of dipper piston and cylinder assembly 35 has a clevis 59 and with clevis 60 on the rearward end of bucket piston and cylinder assembly 37 are pivotally mounted on pin 36. Spacers 61 center clevises 59 an 60 between the two segments of dipper 27.

The forward end of bucket piston and cylinder assembly 37 has a clevis 62 mounted on pin 38 to drive the bucket around the axis of pin 31. Similarly extension of dipper piston and cylinder assembly 35 drives the dipper and bucket about the axis of pin 28 and extension of boom piston and cylinder assembly 32 drives the bucket, dipper and boom assembly about the axis of pin 26.

Figure 4:
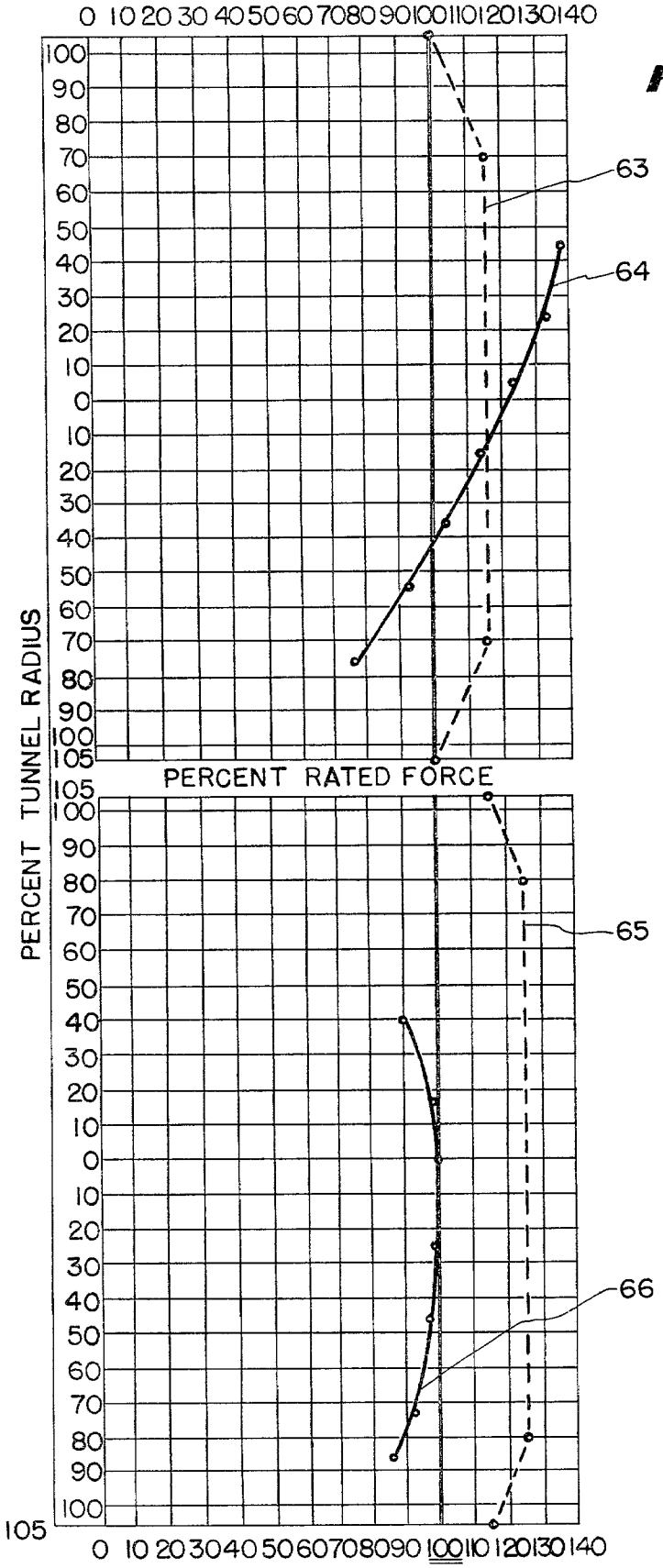

FIG. 4 shows that breakout force at the cutting edge of bucket scoops 29 is even more uniform about the total circular area of movement of the bucket scoop 29 from the central axis of the shield 11, radially outward to a point near the circumference of the shield 11. FIG. 4 shows the breakout force for a boom bucket combination which is approximately 16 feet from the central axis. Line 63 shows the breakout force for the rear end of the boom bucket dipper excavator shown in co-pending application Ser. No. 013,523 which has the boom piston and cylinder assembly mounted on an ear projecting from a mounting ring. Line 64 depicts the breakout force of modified form of excavator having the boom and dipper elements locked with respect to each other or replaced by a longer boom element having the same length as those two elements. Line 65 depicts the breakout force of the excavator described above in applicant's preferred embodiment. Line 66 shows the breakout force of a modified form of the excavator assembly described in this application which has a longer boom of the same length as the boom and dipper or if the boom and dipper were immovable with respect to each other.

What is claimed is:

1. In a tunnelling machine of the type including a hollow shield having a cross section substantially the same as that of the tunnel in which an articulated excavator is mounted, the improvement comprising; a non-rotatable outer housing means mounted to said shield for longitudinal movement therein, bearing means supported by said outer housing means and having an open center aligned with said outer housing means, an inner housing means mounted on said bearing means for rotation about a longitudinal axis of said shield, said inner housing means having excavator mounting means on its forward portion and a rearward portion extending through said bearing means and into said outer housing means, boom cylinder mounting means located at the rearward portion of said inner housing means, excavator means including a boom means and bucket means pivotally mounted on said excavator mounting means for pivotal movement about an axis transverse to the longitudinal axis of said shield, boom cylinder means for articulating said excavator means having its forward portion pivotally mounted on said boom means and extending rearwardly through the open center of said bearing means and having its rearward portion pivotally connected to said boom cylinder mounting means at the rearward portion of said inner housing means.

2. The tunneling machine of claim 1, wherein the boom means is generally triangular in configuration.

3. The tunneling machine of claim 1 wherein the boom means is generally "L" shaped in configuration.

4. The tunneling machine of claim 1, wherein the boom means has a bucket pivot pin at its forward end and a boom pivot pin and a boom cylinder pivot pin at its rearward end, said pins having axes disposed in two planes disposed at at least right angles to each other and intersecting at the axis of the boom pivot pin.

5. The tunneling machine of claim 1 wherein the excavator means further includes a dipper means.

6. The tunneling machine of claim 5, wherein the boom means and dipper means are generally triangular in configuration.

7. The tunneling machine of claim 5 wherein the boom means and dipper means are generally "L" shaped in configuration.

8. The tunneling machine of claim 5 wherein the boom has a dipper pivot pin at its forward end and a boom pivot pin and boom cylinder pin in its rearward end, said pins having axes disposed in two planes, disposed at at least right angles to each other and intersecting at the axis of the boom pivot pin; the dipper means has a bucket pivot in its forward end and a dipper pivot pin and a dipper cylinder pivot pin at its rearward end, said pins having axes disposed in two planes, disposed at at least right angles to each other and intersecting at the axis of the dipper pivot pin.

* * * * *